US008820396B2

(12) United States Patent
Cumby et al.

(10) Patent No.: US 8,820,396 B2
(45) Date of Patent: Sep. 2, 2014

(54) ULTRA HIGH PRESSURE HYDRAULIC SUBLEVEL PIPE CUTTER

(75) Inventors: Sandy Cumby, Marwayne (CA); Tim Sharp, Marwayne (CA); Troy Illingworth, Dewberry (CA)

(73) Assignee: NuWave Industries Inc., Alberta (CA)

( * ) Notice: Subject to any disclaimer, the term of this patent is extended or adjusted under 35 U.S.C. 154(b) by 329 days.

(21) Appl. No.: 13/292,894

(22) Filed: Nov. 9, 2011

(65) Prior Publication Data

US 2013/0112393 A1 May 9, 2013

(51) Int. Cl.
*E21B 29/00* (2006.01)

(52) U.S. Cl.
USPC ..... 166/55.6; 166/55; 166/55.7

(58) Field of Classification Search
CPC ..... E21B 29/00
USPC ..... 166/376, 55, 55.6, 55.7, 55.8, 55.2, 166/75.11
See application file for complete search history.

(56) References Cited

U.S. PATENT DOCUMENTS

| | | | | |
|---|---|---|---|---|
| 5,381,631 | A * | 1/1995 | Raghavan et al. | 451/75 |
| 5,685,078 | A | 11/1997 | Obst et al. | |
| 7,306,031 | B2 * | 12/2007 | Wright et al. | 166/68.5 |
| 2007/0175636 | A1 * | 8/2007 | McAfee | 166/297 |

* cited by examiner

*Primary Examiner* — Brad Harcourt
(74) *Attorney, Agent, or Firm* — Gilberto M. Villacorta; Karl F. Reichenberger; Foley & Lardner LLP

(57) ABSTRACT

An ultra-high pressure (UHP) cutting device for insertion into a wellbore for cutting the casing of the wellbore from within the wellbore is provided. The cutting device comprises a UHP hose connector for connection with a UHP hose in communication with a fluid source; a rotatable UHP tube with a top end in fluid communication with the UHP hose connector and a bottom end opposite the top end; a rotating means in operational communication with the UHP tube for rotating the UHP tube during operation of the cutting device; and a cutter head in fluid communication with the bottom end of the UHP tube.

12 Claims, 8 Drawing Sheets

Set up adjustment cut head

| Cut | Focus tube | cod | Cut | Focus tube | cod | Cut | Focus tube | cod |
|---|---|---|---|---|---|---|---|---|
| 3 ¾ | 1 ½ | AID | 8 ¾ | 2 | AEID | 11 7/8 | 3 | COD |
| 4 ¼ | 1 ½ | CID | 9 | 1 1/2 | AOD | 12 ¼ | 1 ½ | CEOD |
| 4 ¾ | 2 | AID | 9 ¼ | 2 | CEID | 12 ½ | 3 | AOD |
| 5 ¼ | 2 | CID | 9 3/8 | 2 | COD | 12 ½ | 2 ½ | BE |
| 5 ¾ | 2 ½ | AID | 9 ¾ | 2 ½ | AEID | 13 | 1 ½ | AEOD |
| 6 ¼ | 2 ½ | CID | 9 ¾ | 3 | B | 13 ¼ | 2 | CEOD |
| 6 ¼ | 1 ½ | B | 10 | 2 | AOD | 14 | 2 | AEOD |
| 7 ¼ | 3 | AID | 10 ¼ | 2 ½ | CEID | 14 | 3 | BE |
| 7 ¼ | 2 | B | 10 3/8 | 2 ½ | COD | 14 ¼ | 2 ½ | CEOD |
| 7 ¾ | 1 ½ | AEID | 10 ½ | 1 ½ | BE | 15 | 2 ½ | AEOD |
| 7 ¾ | 3 | CID | 11 | 2 ½ | AOD | 15 ¾ | 3 | CEOD |
| 8 ¼ | 2 ½ | B | 11 ¼ | 3 | AEID | 16 ½ | 3 | AEOD |
| 8 ¼ | 1 ½ | CEID | 11 ½ | 2 | BE | | | |
| 8 3/8 | 1 ½ | CO | 11 ¾ | 3 | CEID | | | |

Figure 7

ULTRA HIGH PRESSURE HYDRAULIC SUBLEVEL PIPE CUTTER

FIELD OF THE INVENTION

The present invention relates to ultra-high pressure (UHP) cutters, and specifically to UHP cutters for sublevel use for cutting pipe casings and liners for example in the dismantling of existing oil, gas and/or utility well bores or lines.

BACKGROUND

The abandonment of non-producing or uneconomic oil or gas wells presents a number of safety and environment issues. Typically, in the abandonment process, all production and surface wellbore casings along with conductor barrels and cement liners have to be removed to a depth of two meters below the surface.

A previous method for such removal required a large scale excavation of soil from around the existing wellbore. In order to do this, line location companies needed to be brought in to determine locations of any existing oil, gas and/or utility lines. Proper safety practices typically require that a very large area be excavated to allow a welder and an assistant to descend into the area to the required depth to cut the existing steel casings and cement liners. This cutting of the casing is done using a cutting torch.

Typically, the casing is cut horizontally and then vertically to remove the outer layer. Any cement present then has to be removed using either a jackhammer or sledge hammer. This allows access to secondary steel casings that are cut using the cutting torch again.

Throughout this process, a source of ignition, the cutting torch, is being used in an area wherein there is a possibility for the presence of explosive or flammable gases or liquids. This type of work environment may be referred to as a hot work area. A significant safety threat is inherent for the personnel in a hot work area and is further exasperated through the used of a cutting torch or any other heat based cutting tool.

One previous attempt at overcoming this issue was to provide a different type of tool consisting of metal blades that would be lowered inside the casing and then rotated and expanded to cut through the casing. Such a tool is described in U.S. Patent 5,685,078. Some problems associate with this tool and this method of cutting are that if there is an movement of the casing while being cut, the tool becomes jammed inside the casing. In addition, being a metal on metal cut, there is still the possibility of sparking which can ignite any explosive or flammable gas or fluid and can also cause a heat build-up which may ignite any explosive or flammable gas or fluid in the hot work area. Further, the tool can only cut only layer at a time and has to be removed and set to a different cutting depth for each cut. Finally, this type of tool does not cut well or sometime at all, though cement.

There is therefore a need to provide a cutting tool that overcomes one or more of the shortcomings of the current cutting tools or methods outlined above and/or observed in the field.

SUMMARY OF THE INVENTION

An ultra-high pressure (UHP) cutting device is provided that foregoes the need for heat or spark generating friction to cut through the components of a wellbore, including the liner and the casing, from the inside to the outside. Ultra-high pressure fluid, optionally in combination with an abrasive, is used to cut through the wellbore and as a result the risk of igniting explosive or flammable gas or fluid is greatly reduced or removed. By using a tool, insertable into the wellbore casing, that cuts from the inside of the bore to the outside, the need for excavation around the well is reduced or avoided. In addition, the UHP cutting device may cut through multiple layers of steel and/or cement in a single pass thereby avoiding the need to reset the cutting tool to different depths for each pass or each cut.

In one embodiment, the UHP cutting device may be designed to be of a sufficient weight to be a portable unit that is sufficiently quick and easy to assembly so that it may be used in extreme cold weather conditions, where, typically, water usage would not be practical.

One embodiment of the invention provides for an ultra-high pressure (UHP) cutting device for insertion into a wellbore for cutting the casing of the wellbore from within the wellbore, the UHP cutting device comprising:

a UHP hose connector for connection with a UHP hose in communication with a fluid source;

a rotatable UHP tube with a top end in fluid communication with the UHP hose connector and a bottom end opposite the top end;

a rotating means in operational communication with the UHP tube for rotating the UHP tube during operation of the cutting device; and a cutter head in fluid communication with the bottom end of the UHP tube, the cutter head comprising:

- a UHP elbow for changing the direction of UHP fluid flow from a direction substantially parallel with the wellbore to a direction toward the inner surface of the wellbore;
- an abrasive feed port for connection with an abrasive feed line for receiving abrasive to be mixed with the UHP fluid; and
- a focus tube for directing the mixture of UHP fluid and abrasive out of the cutter head and toward the inner surface of the wellbore to be cut.

In addition to the embodiment(s) outlined above, the cutting device may further comprise a centralizer device for centering the UHP tube in the wellbore during operation of the cutting device.

In addition to the embodiment(s) outlined above, the cutting device may further comprise a hollow housing situated around a majority of the length of the UHP tube, the housing fixed to a non-rotating component of the cutting device such that the housing remains stationary during rotation of the UHP tube.

In addition to the embodiment(s) outlined above, the centralizer device comprises:

a centralizer adjustment block slidable along the housing and lockable to the housing to prevent sliding of the centralizer adjustment block when locked;

an expandable centralizer rod system comprising a series of rods and hinges;

centralizer adjustment rods connected at an upper end to the centralizer adjustment block and at a lower end to the centralizer rod system such that downward sliding of the centralizer adjustment block operates the hinges of the centralizer rod system and expands the outside diameter of the centralizer rod system and upward sliding of the centralizer adjustment block operates the hinges of the centralizer rod system to collapse the outside diameter of the centralizer rod system;

a locking device in communication with the centralizer adjustment rods, wherein operation of the device provides for a small expansion of the centralizer rod system via the centralizer adjustment rods for locking the centralizer rod system against an inner surface of the wellbore; and a centralizer mounting bracket fixed to the housing for connection of the centralizer device to the cutting device;

wherein expansion of the centralizer rod system until the rods of the centralizer rod system contact the inner surface of the wellbore centers the UHP tube in the wellbore.

In addition to the embodiment(s) outlined above, the locking device is a locking handle or a locking bolt.

In addition to the embodiment(s) outlined above, the cutting head further comprises an orifice assembly for reducing the fluid flow rate and increasing the fluid pressure.

In addition to the embodiment(s) outlined above, the cutting device further comprises a UHP manifold in fluid communication with the UHP tube and the cutter head, the UHP manifold comprising a plurality of fluid transmission holes, each hole suitable for connection with the cutter head to orient the cutter head at a different offset from the UHP tube thereby providing a different offset for the focus tube.

In addition to the embodiment(s) outlined above, the cutting device further comprises a gear reduction unit in communication with the rotating means and the UHP tube for reducing the rate of rotation of the UHP tube provided by the rotation means.

In addition to the embodiment(s) outlined above, the rotating means is a hydraulic motor.

In addition to the embodiment(s) outlined above, the cutting device further comprises a UHP swivel attachment connected to the UHP hose connector and the UHP tube, the UHP swivel attachment providing a sealed rotatable connection between the UHP tube and the UHP hose connector allowing the UHP tube to rotate while the UHP hose connector remains stationary.

In another embodiment, the present invention provides for an ultra-high pressure (UHP) cutting device for insertion into a wellbore for cutting the casing of the wellbore from within the wellbore, the UHP cutting device comprising:

a UHP hose connector for connection with a UHP hose in communication with a fluid source;

a rotatable UHP tube with a top end in fluid communication with the UHP hose connector and a bottom end opposite the top end;

a UHP swivel attachment connected to the UHP hose connector and the UHP tube, the UHP swivel attachment providing a sealed rotatable connection between the UHP tube and the UHP hose connector allowing the UHP tube to rotate while the UHP hose connector remains stationary;

a hollow housing situated around a majority of the length of the UHP tube, the housing fixed to a non-rotating component of the cutting device such that the housing remains stationary during rotation of the UHP tube;

a rotating means in operational communication with the UHP tube for rotating the UHP tube during operation of the cutting device;

a gear reduction unit in communication with the rotating means and the UHP tube for reducing the rate of rotation of the UHP tube provided by the rotation means;

a cutter head in fluid communication with the bottom end of the UHP tube, the cutter head comprising:

a UHP elbow for changing the direction of UHP fluid flow from a direction substantially parallel with the wellbore to a direction toward the inner surface of the wellbore;

an abrasive feed port for connection with an abrasive feed line for receiving abrasive to be mixed with the UHP fluid;

a focus tube for directing the mixture of UHP fluid and abrasive out of the cutter head and toward the inner surface of the wellbore to be cut; and a centralizer device for centering the UHP tube in the wellbore during operation of the cutting device, the centralizer device comprising:

a centralizer adjustment block slidable along the housing and lockable to the housing to prevent sliding of the centralizer adjustment block when locked;

an expandable centralizer rod system comprising a series of rods and hinges;

centralizer adjustment rods connected at an upper end to the centralizer adjustment block and at a lower end to the centralizer rod system such that downward sliding of the centralizer adjustment block operates the hinges of the centralizer rod system and expands the outside diameter of the centralizer rod system and upward sliding of the centralizer adjustment block operates the hinges of the centralizer rod system to collapse the outside diameter of the centralizer rod system;

a locking device in communication with the centralizer adjustment rods, wherein operation of the device provides for a small expansion of the centralizer rod system via the centralizer adjustment rods for locking the centralizer rod system against an inner surface of the wellbore; and a centralizer mounting bracket fixed to the housing for connection of the centralizer device to the cutting device;

wherein expansion of the centralizer rod system until the rods of the centralizer rod system contact the inner surface of the wellbore centers the UHP tube in the wellbore.

In addition to the embodiment(s) outlined above, the rotating means is a hydraulic motor.

In addition to the embodiment(s) outlined above, the cutting head further comprises an orifice assembly for reducing the fluid flow rate and increasing the fluid pressure.

In addition to the embodiment(s) outlined above, the cutting device further comprises a UHP manifold in fluid communication with the UHP tube and the cutter head, the UHP manifold comprising a plurality of fluid transmission holes, each hole suitable for connection with the cutter head to orient the cutter head at a different offset from the UHP tube thereby providing a different offset for the focus tube.

In addition to the embodiment(s) outlined above, the UHP tube is a stainless steel UHP tube.

BRIEF DESCRIPTION OF THE DRAWINGS

FIG. 7 is a chart showing data relating to suitable focus tube lengths relating to the diameter of the wellbore for one embodiment of a focus tube.

DETAILED DESCRIPTION

Generally, once an oil or gas well is non-producing or uneconomical to continue operation, the surface abandonment of the well is carried out. The surface abandonment typically involves the removal of all production and surface wellbore casings along with cement liners to a depth of two meters below the surface. An ultra-high pressure (UHP) cutting device for insertion into a wellbore for cutting through the casing and, if present, the liner of the well so that the wellbore casing and liner may be removed to a depth of two meters below the surface without the need for excavation of the site is provided and shown schematically, in one embodiment thereof, with reference to FIG. 1.

One embodiment of the UHP cutting device is shown generally at 30. The cutting device 30 is inserted into the wellbore to be cut (not shown) and a combination of fluid, typically water, and an abrasive are exhausted through a focus tube 23 substantially perpendicular to the casing or liner into the casing or liner at an ultra-high pressure sufficient to cut through the casing and liner. The cutting device 30 is rotated during operation so that a continuous cut through the liner and casing is made upon completion of a full rotation of the cutter head 21. It will be appreciated that the pressure and rate of rotation may be determined based on the materials and thickness of the casing and liner as well as the strength of the components of the cutting device 30.

Figure 1:
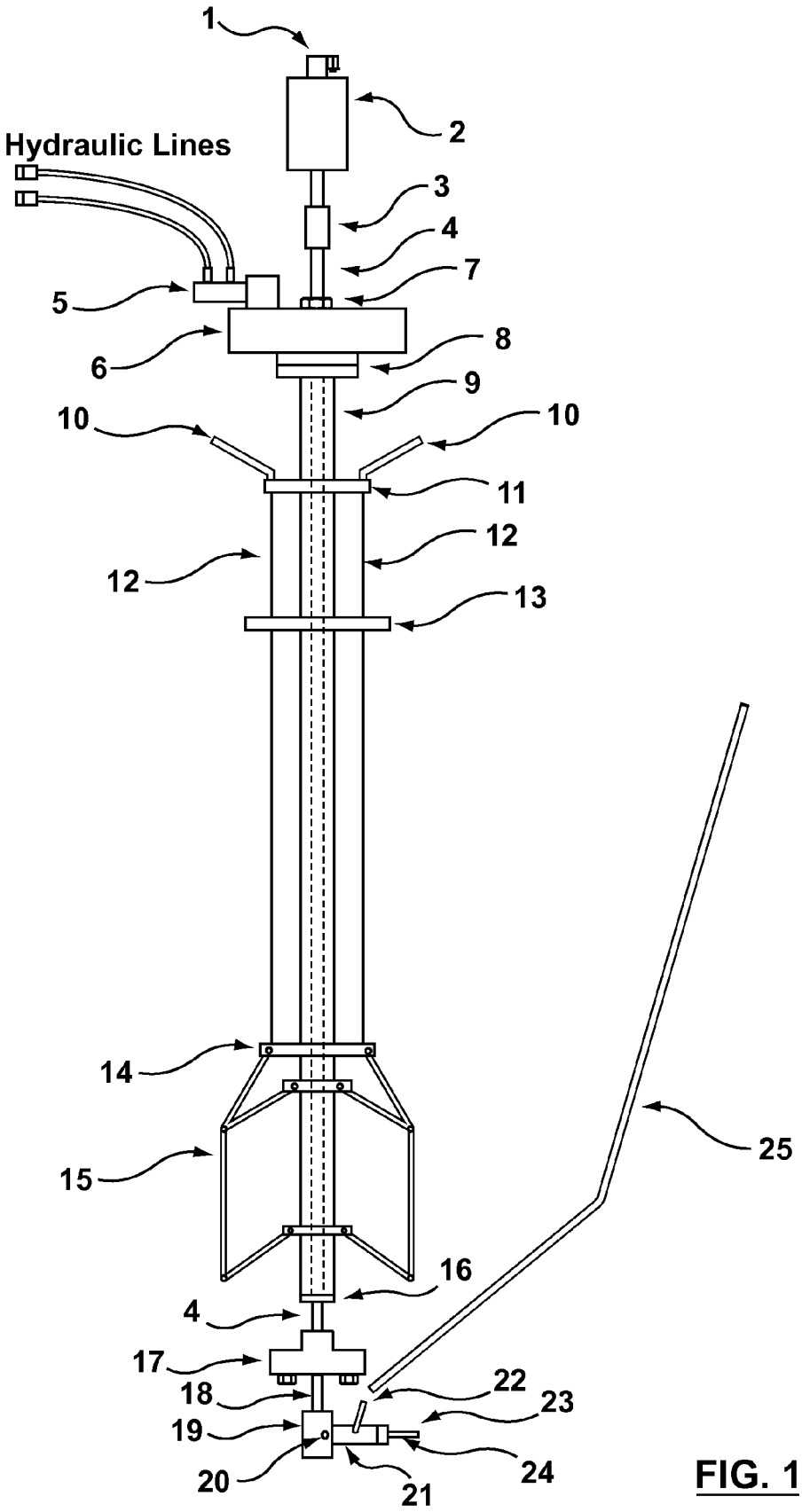
FIG. 1 is a schematic view illustrative of one embodiment of a UHP cutting device for insertion into a wellbore or the like, for cutting through the components of the wellbore including the liner and the casing.

The cutting device 30 shown in FIG. 1 comprises a UHP hose connection 1 at a top of the cutting device so that a UHP hose may be connected for delivering fluid, such as water, from an UHP pump. Generally, the UHP hose is connected after insertion of the cutting device 30 into a wellbore, however, connection may be done before insertion of the cutting device into the wellbore. By positioning the UHP hose connection 1 at or near the top of the cutting device 30, connection of the UHP hose after insertion of the cutting device 30 is facilitated. This also helps to reduced tangling of the UHP hose and ease of rotation of the cutting device 30 during operation.

A swivel attachment 2 provides a fluid connection from the UHP hose connection 1 with a UHP tube 4, typically a stainless steel tube, and allows the UHP hose to remain substantially stationary or non-rotational when the UHP tube 4 is rotating during operation of the cutting device 30. A collar 3 may be used to fluidly connect the swivel attachment 2 with the UHP tube 4. It will be appreciated that all connections must be sufficiently robust to withstand ultra-high pressures without leaking or breaking The UHP tube 4 extends to the bottom of the cutting device 30 and allows for fluid communication of the fluid with a UHP manifold 17 which directs the UHP fluid through a UHP elbow 19, generally 90 degrees, with an orifice assembly 20. The orifice assembly 20 reduces the fluid flow rate and increases the pressure of the fluid as it travels to the cutter head 21 and is directed out of the focus tube 23. The cutter head 21 includes an abrasive feed port 22 to which an abrasive feed line 25 is attached for supplying abrasive to the cutter head from an external abrasive source for combining with the fluid for eventual direction out through the focus tube 23. During normal operation, the abrasive that is fed to the cutter head 21 through the abrasive feed port 22 is drawn though the abrasive feed line 25 by suction, or a reduction in pressure, created by the high pressure fluid, namely water, passing over the abrasive feed port 22 in the cutter head 21.

Figure 8:
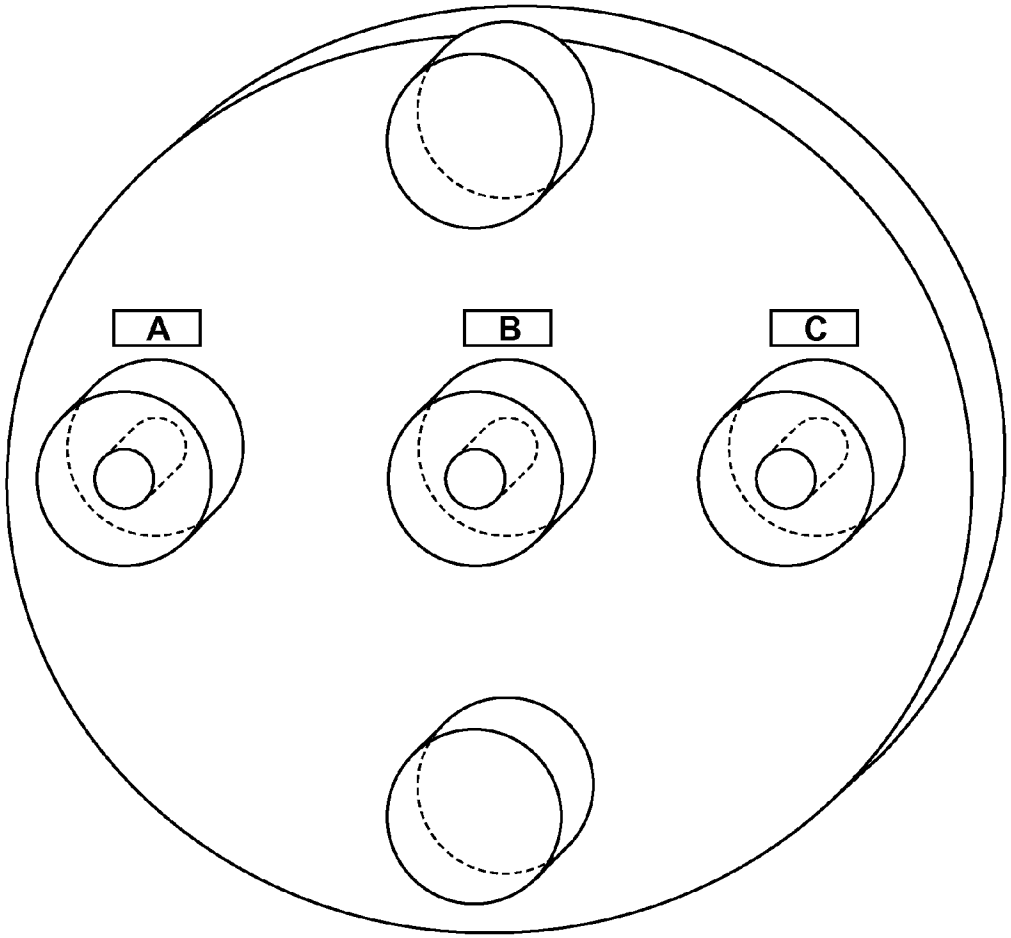
FIG. 8 is a front elevation view of one example of a UHP manifold for use with an embodiment of a cutting device.

The UHP manifold 17 may contain a number of apertures suitable for fluid transmission from the UHP tube 4 to the cutter head 21. The positioning of each aperture allows for various offset changes in the cutter head 21 and by extension the focus tube 23 by directing the flow of the UHP fluid through a particular aperture. In addition, the diameter of any of the apertures in the manifold 17 may be different than the inside diameter of the UHP tube 4 thereby effecting the fluid pressure in the cutter head 21. The cutter head 21 may be connected directly or indirectly to any of the apertures in the UHP manifold 17 to allow for a suitable distance between the focus tube 23 and the inner surface of the liner or casing. One example of a UHP manifold 17 is shown in FIG. 8 which contains apertures A, B and C. On the UHP manifold 17, aperture A is the farthest aperture from the center of the UHP manifold 17, aperture B is the center aperture and aperture C is closer to B then A to allow for a variety of potential setups and distances. Optionally, an extension head in communication with any of the apertures on one end and the cutter head 21 may be used to reposition the cutter 21 at a desired position a suitable distance from the inner surface of the wellbore.

A tube nipple with gland nut 18 may be used to attach the UHP elbow 19 to the UHP manifold 17. A collet and nut 24 may be used to retain the focus tube 23 inside the cutter head 21.

Figure 6:
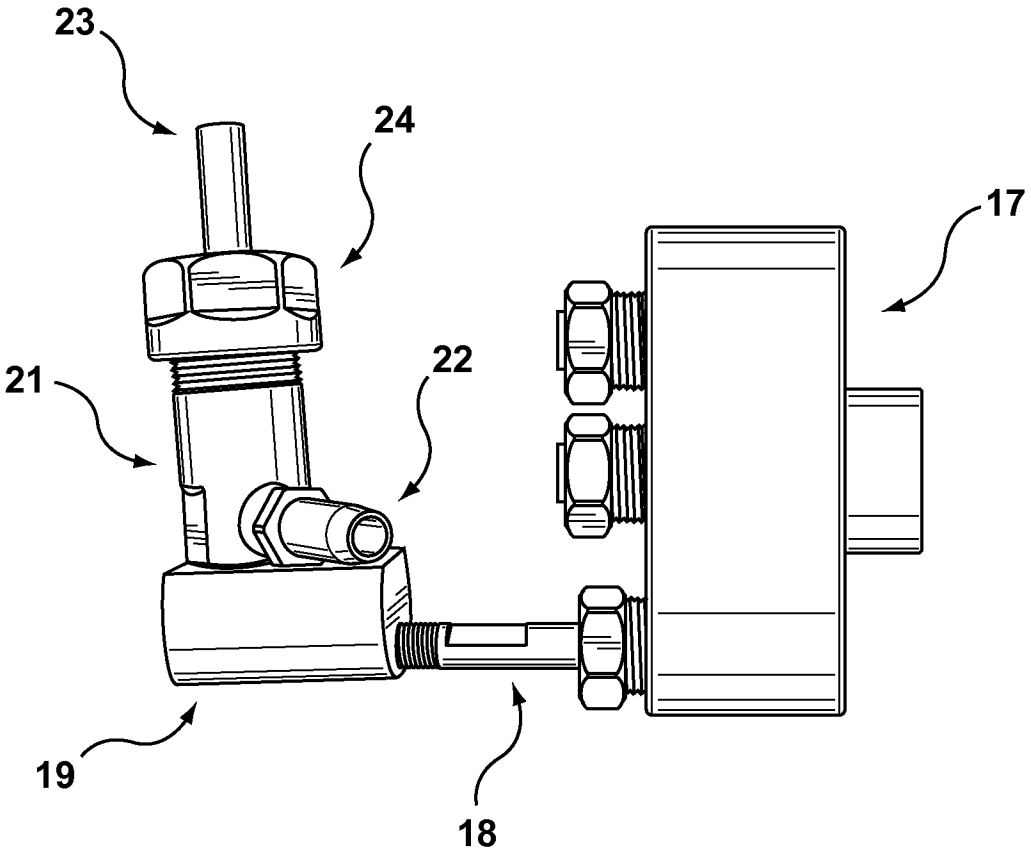
FIG. 6 is a photograph illustrative of one embodiment of a cutter head and a manifold assembly for a UHP cutting device.

One embodiment of a cutter head 21 with a focus tube 23, abrasive feed port 22, tube nipple with gland nut 18, UHP elbow 19, collet and nut 24 and UHP manifold 17 is shown in detail in the photograph of FIG. 6.

A rotating means is used to rotate the UHP tube 4 and thereby rotate the cutter head 21 and the focus tube 23 to rotate the direction of the fluid/abrasive around the circumference of the wellbore so that the liner and casing are cut. As will be appreciated, the rotating means may be external the cutting device 30. However, to allow for ease of use and portability, the rotating means may be attached to the cutting device 30 and should also be of a sufficiently small size and shape so that it fits into the wellbore when the cutting device is inserted. In the embodiment illustrated in FIG. 1, a hydraulic motor 5 is used in connection with a gear reduction unit 6 in communication with the UHP tube 4. The hydraulic motor 5 rotates the UHP tube 4 via the gear reduction unit 6 which has includes gearing to reduce the rate of rotation of the UHP tube 4. It will be appreciated that any suitable hydraulic more 5 and gear reduction unit 6 may be used that provides for rotation of the UHP tube 4 at a rate suitable to cut the liner and casing of the wellbore at the desired fluid pressure. It will also be appreciated that any method or means of operatively connecting the hydraulic motor 5, the gear reduction unit 6 and the UHP tube 4 may be employed. In the embodiment shown in FIG. 1, a gland nut 7 is used to secure the UHP tube 4 with the gear reduction unit 6 to allow for rotation of the UHP tube 4. Hydraulic fluid lines in communication with a reservoir or other fluid source are used to input and output hydraulic fluid to the hydraulic motor 5.

A housing 9 is used to house the UHP tube 4 which passes through the housing 9. The housing 9 basically acts as a shield and allows the UHP tube 4 to rotate inside the housing 9 while the housing 9 remains stationary. The housing 9 also acts as a mounting point for the hydraulic motor 5 and gear reduction unit 6 in addition to other components that do not rotate during operation of the cutter head 21. A mounting bracket 8 is shown as connecting the gear reduction unit 6 to the housing 9 that surrounds the UHP tube 4. It will be appreciated that any means may be used to connect the gear reduction unit 6 and/or the hydraulic motor 5 with the housing 9. A bushing 16 may be used to locate or centre the UHP tube 4 in the housing 9 and allow rotation of the UHP tube 4 in the housing while ensuring the UHP tube 4 does not touch the sides of the housing 9. The bushing 16 may be a brass bushing.

Figure 2:
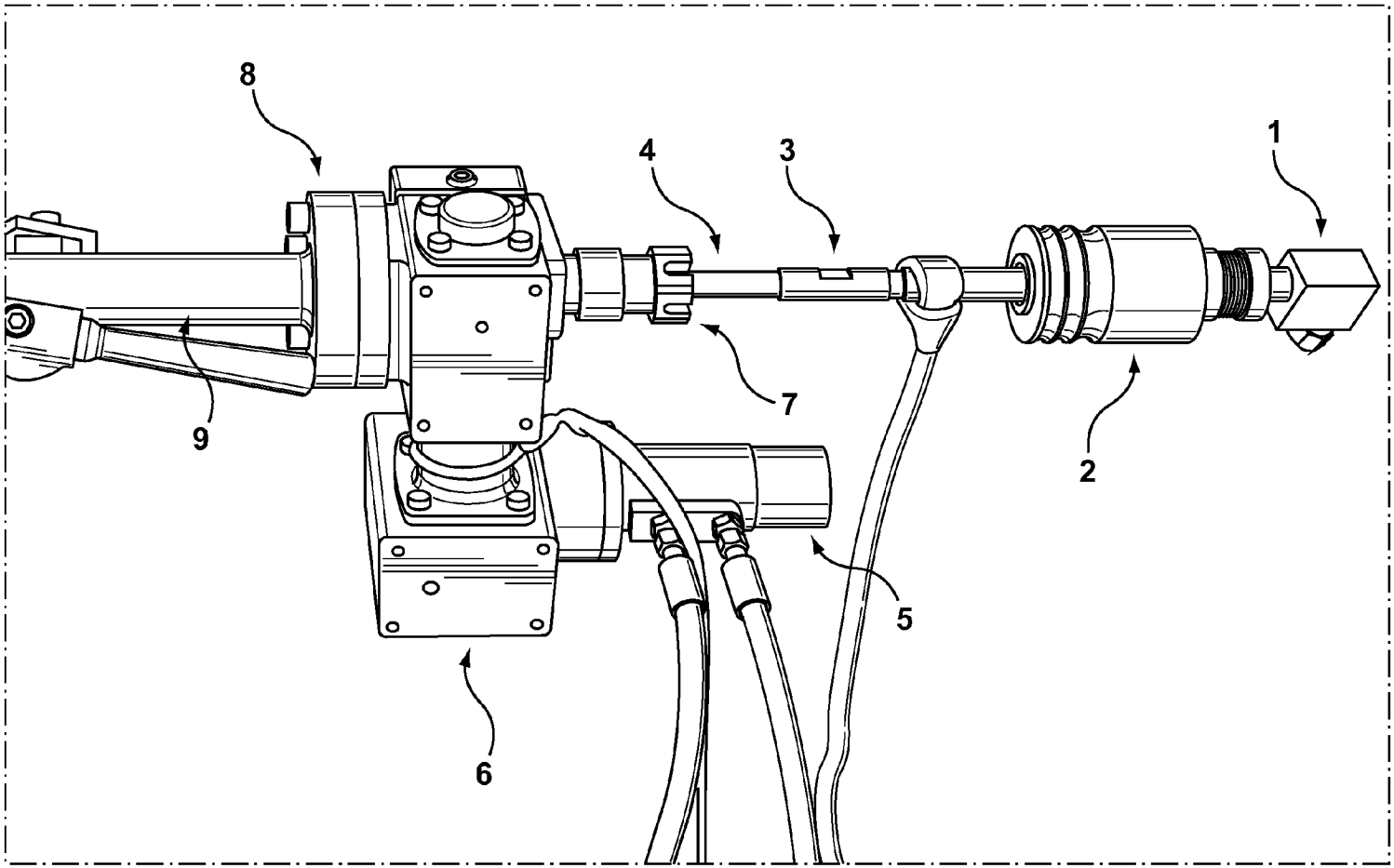
FIG. 2 is a photograph illustrative of one embodiment of a UHP swivel attachment and a hydraulic setup for a UHP cutting device.

One example of the top end setup of a UHP cutting device 30 with the hydraulic lines attached before insertion into a wellbore is shown in FIG. 2.

Figure 5:
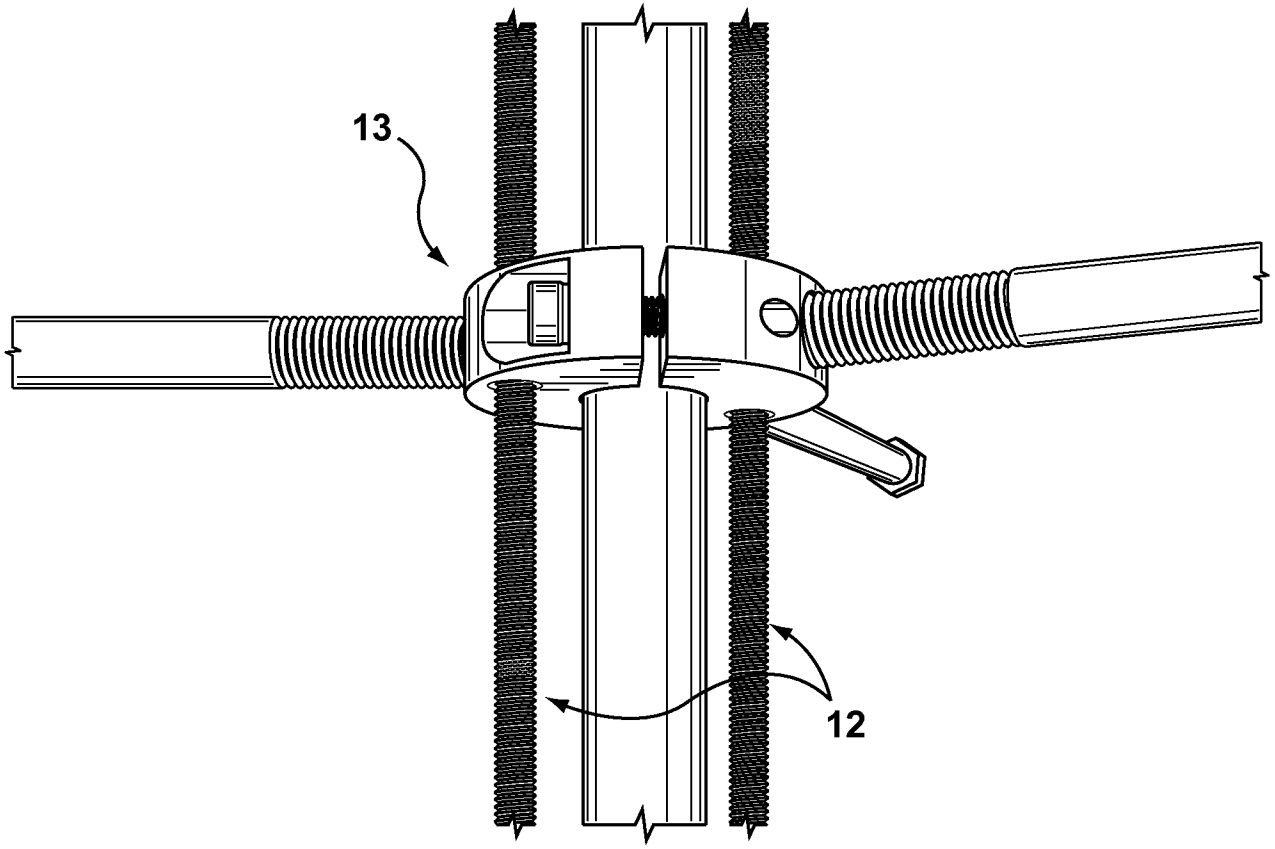
FIG. 5 is a photograph illustrative of one embodiment of a depth adjustment block with optional size extensions for a UHP cutting device.

As outlined above, typically, the abandonment process of a non-producing or uneconomic oil or gas well calls for the removal of wellbore casings along with liners to a predetermined depth, generally of two meters below the surface. As wellbore casings extend above the ground a varying amount from casing to casing, the distance that the wellbore casing extends above the ground my be determined and taken into consideration when determining the depth that the cut must be made at to ensure that the casing and liner is removed up to the predetermined amount. For example, if the well casing extends 0.5 meters above the ground, the depth of the cut must be set at 2.5 meters to ensure that the casing may be removed up to a mandated 2.0 meters below the surface. To allow for adjustability of the depth of the cut, the UHP cutting device 30 may include a depth adjustment block 13, one embodiment of which is shown in FIG. 1. The depth adjustment block 13 is shown as being connected to the housing 9. The depth adjustment block 9 is longitudinally adjustable along the length of the housing 9 so that the depth of the cut may be preset. Once adjusted, the depth adjustment block 9 rests on the top surface of the well casing with the cutter head 21 extending downward into the casing and presenting the focus tube 23 at the desired depth. Optionally, the depth adjustment block 9 may include size extension rods as shown in FIG. 5 to expand the diameter over which the depth adjustment block 9 may rest. It will be appreciated that the depth adjustment block 9 may be of various configurations and may be adapted to connect or rest upon various components of the ground surrounding the casing or elements within the casing, so long as the depth adjustment block 9 is of sufficient strength and sturdiness to hold the cutter head 21 at a consistent depth during rotation of the UHP tube 4.

The end of the focus tube 23 should ideally remain at a consistent distance from the internal surface of the wellbore during rotation of the cutter head 21. In other words, the cutting device 30 should ideally be centered in the wellbore. A centralizing device may be included with the cutting device 30 to automatically center the UHP tube 4 in the wellbore so that during rotation of the UHP tube 4, the end of the focus tube 23 remains and a consistent distance from the inner surface of the wellbore, assuming the wellbore is round.

Figure 3:
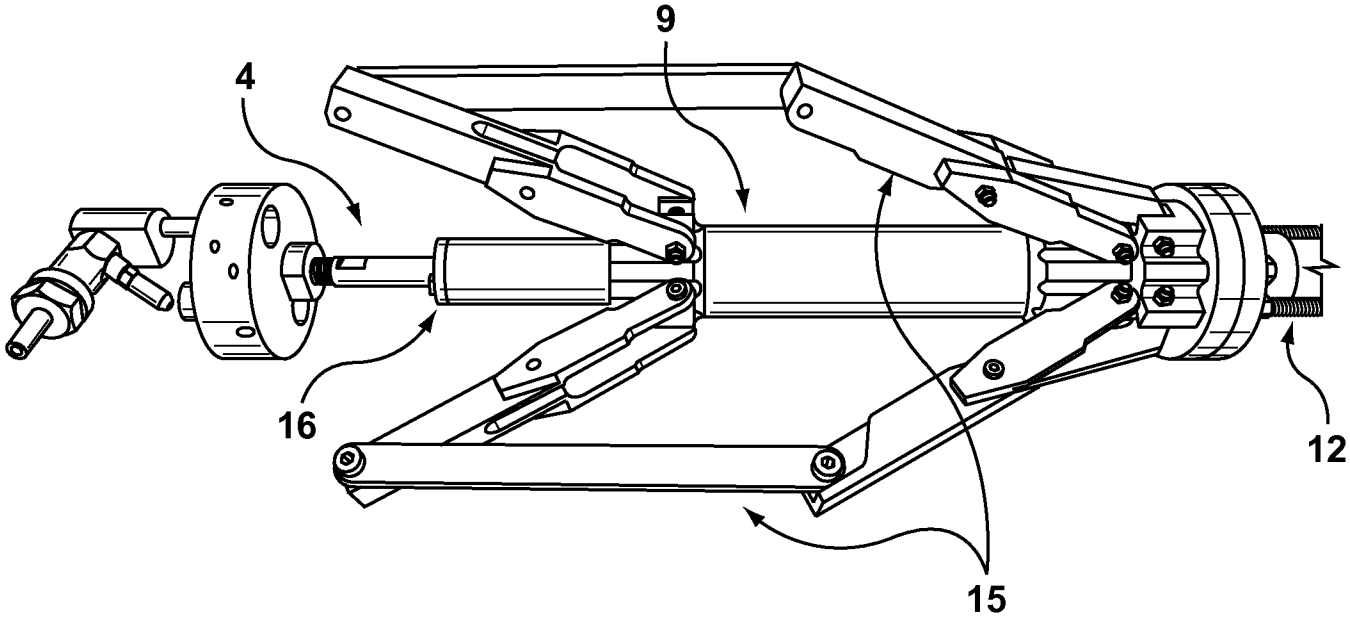
FIG. 3 is a photograph illustrative of one embodiment of a centralizer system for a UHP cutting device.
Figure 4:
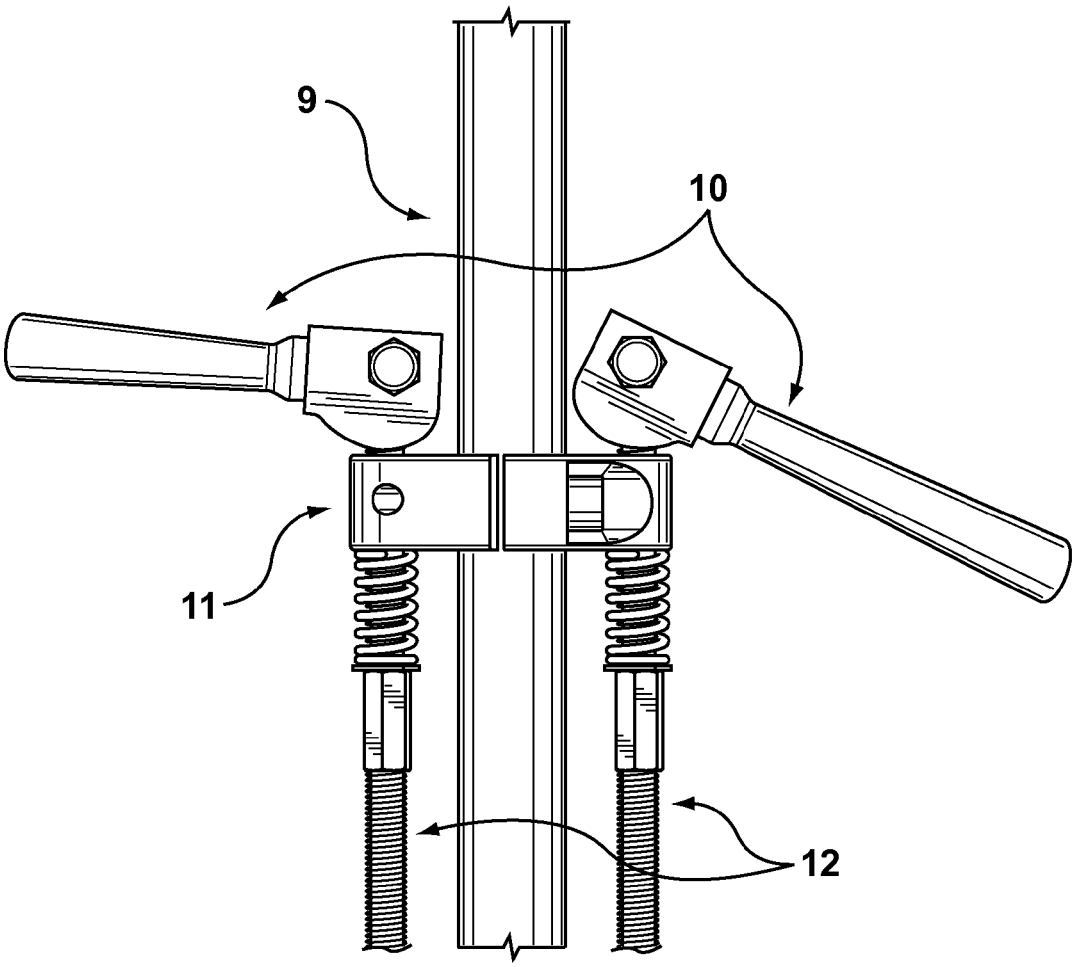
FIG. 4 is a photograph illustrative of one embodiment of a centralizer adjustment assembly for a UHP cutting device.

In addition to FIG. 1, the components of one embodiment of a centralizing device are also shown in FIGS. 3 and 4. This embodiment of a centralizing device includes a centralizer mounting bracket 14 connected to the housing 9 that serves to connect a centralizer rod system 15 to the stationary housing 9. The centralizer rod system 15 comprises an expandable web-like system of rods and hinged joints, where, upon operation of centralizer adjustment rods 12, the diameters of the centralizer rod system 15 uniformally expands until it touches the inner surface of the wellbore thereby centering the housing 9 and the UHP tube 4 in the wellbore. Expansion of the centralizer rod system 15 is controlled by the longitudinal sliding of the centralizer adjustment block 11 along the longitudinal axis of the housing 9. Sliding the centralizer adjust block 11 downward, pushes the centralizer adjustment rods 12 downward and forces the rods and hinged joints of the centralizer rod system 15 expand outwards. The centralizer rod system 15 should be expanded until all outside rods of the centralizer rod system 15 touch the inner surface of the wellbore thereby centering the UHP tube 4 in the center of the wellbore liner or casing. Once the centralizer rod system 15 has been expanded to the point where the outside rods touch the inner surface of the wellbore, the locking handles 10 on the centralizer rod system 15 are then tightened. Each handle 10 pulls on one of the centralizer adjustment rods 12 and expands the centralizer more fully to create a better compression against the inner surface and locks the system in place. It will be appreciated that any type of locking system may be used to secure the centralizer adjustment block in place so that, once centered, the UHP tube 4 may be rotated without displacing the UHP tube 4 from the center of the wellbore casing or liner. It was also be appreciated that the centralizer rod system 15 may comprise any suitable number or setup of rods and hinges so that expansion of the rods against the inner surface of the wellbore casing or liner centers the UHP tube 4 in the wellbore casing or liner.

With respect to the abrasive that may be used, one example is a garnet abrasive. The size of garnet usually ranges from 30 grit, 50 grit and 80 grit sizes. The 50 grit size is generally used as this seems to give an ideal cut to wear ratio to the cutter heads and focus tubes. The smaller 80 grit will cut and create less wear on the consumables but takes a much longer time to cut. The larger 30 grit will cut faster but causes the cutter head and focus tubes to wear more quickly.

Example of Operation of the Cutter Device

It will be appreciated that the following example of the operation of the cutting device is merely an example of one method of operating the cutting device and should not be interpreted as limiting or the soul method of operating the device. The order of steps outlined below is not essential to the successful operation of the device. Variations may be made to the techniques, steps and order that are encompassed in the concept of operation of the cutting device. None of the steps below are to be considered limiting and are merely illustrative of one method of using one embodiment of a cutting device.

Once at the site at which the wellbore casing and/or liner is to be removed, the wellhead is removed. This is done by removing the bolts that hold the wellhead to the casing bowl. The casing bowl is welded to the well casing that extends down into the ground.

After removing the wellhead, a measuring device is used to determine the exact size of the inside diameter of the smallest casing string that needs to be cut. The measurement is needed to be able to set up the cutter head for the proper size. Once the correct size is determined, a chart that has been developed (shown in Table 1 in FIG. 7) may be consulted, to select the proper length of focus tube to be used, as well as the location for placement of the cutter head assembly on the manifold. By changing lengths of focus tubes and selecting different diameter ports on the manifold, virtually any production casing ranging from 4" to 16" inside diameter may be cut. The cutter head is assembled and the abrasive feed port is attached to the side of the cutter head and the abrasive feed line is connected to the cutter head.

In the chart shown in FIG. 7, the first letter given in the cod column represents the aperture used. The letter E indicates if an extension head is used to connect the cutter head to the aperture. Letters ID indicate if the cutter head with optional extension head extend across the manifold and the other apertures or OD meaning that the cutter head with optional extension head extend out side the manifold directly without covering the other apertures. For example, AEID means an extension head is used that is connected to the cutter head and aperture A extending across apertures B and C. AID means that the cutter head is connected directly to aperture A and extends across aperture B and C. B means that the cutter head is connected directly to aperture B. AEOD means that an extension head is used connected to aperture A and extends directly out from the manifold without covering the other apertures. In addition, the length of focus tube is also indicated. For example, a focus tube may be of any suitable length, however, the length of focus tube for this example may be between 1.5 and 3 inches as indicated in the chart.

After the cutter head and manifold assembly is prepared, the system is pressure tested to check for leaks. If leaks are present, the unit is reassembled to fix any leaks or problems.

The needed depth of the cutter head may be determined by measuring the height that the casing extends above the ground and adding this to the usual 2 meters that is required below surface. If 0.5 meters is above ground, the depth is set to 2.5 meters. The depth is set by setting the depth adjustment block to the desired location.

To lower the tool into the well, a small block and tackle assembly is used, which is attached to the bucket of a backhoe. The bucket is raised above the well and the tool is lifted straight up above the casing string and then lowered slowly, by hand using the pulley system, into the inner casing string. Attention should be taken to be very careful not to strike the focus tube against the side of the casing as it is being lowered inside, to prevent breaking or bending the focus tube.

Once the tool has been lowered into the casing, the tool is visually centered at the top of the casing. Next, the centralizer rod system is adjusted to the correct size by moving the centralizer adjustment block to the proper location and locking it into position by tightening a bolt which holds it fast to the hollow aluminum tubing. The handles are then compressed, which pulls on the centralizer adjusting rods, expanding the centralizer rods. This centres the cutter head inside the casing and prevents the cutter head from hitting the side of the casing as it rotates inside while cutting.

Next, the hydraulic lines are attached that come from a hydraulic pump inside of the truck unit to the hydraulic motor at the top of the cutting tool. The abrasive feed line is then attached that comes from the cutter head, to the abrasive pot inside the truck. The abrasive that is fed to the cutter head is pulled through the line by a suction which is created by water passing over the abrasive feed port at the cutter head.

The UHP water supply hose from the main pump is then connected to the UHP connection at the top of the cutting device.

When all connections are made, the UHP pump and diesel-powered engine are started along with the hydraulic pump unit. All systems are allowed to idle for several minutes to warm-up before being brought to operating speed.

When the units have been properly warmed up, the unit is brought to full operating pressure by activating a remote system that is attached to the main pump/engine assembly. The water pressure builds quickly through the system due to the orifice at the junction of the cutter head and UHP elbow, which comprises a 90° angle, at the bottom of the cutting device. A water pressure of 43,500 psi is suitable for cutting both cement and stainless steel. This pressure may be controlled by a computer module that can be supplied with the engine/pump assembly.

Once the system reaches the required pressure the abrasive feed line from the cutter head to the abrasive pot is checked for suction. If there is sufficient suction on the line, a valve is opened on the pot which allows the abrasive to flow from the pot to the cutter head.

When the abrasive reaches the cutter head, it is mixed with the water and carried by the water, through the focus tube. The abrasive does the majority if not all of the actual cutting of the steel and cement. The fluid, namely water, delivers the abrasive to the target.

After the unit reaches pressure and the abrasive is being fed through the cutter head, the operator activates the hydraulic control. Using a lever the operator may control the movement of the hydraulic motor forward or reverse. This in turn rotates the gear reduction unit. The gear reduction unit attaches to the UHP stainless steel rod and in turn, rotates the cutter head at the bottom of the cutting tool, moving slightly in either direction until the abrasive pierces the casing and cement, if present. Once the layers of steel casing and cement have been pierced, the operator may leave the hydraulic control lever in the forward position.

The forward speed of the hydraulic motor may be determined by a bypass needle valve that is manually adjustable. As the needle valve is opened, more hydraulic fluid passes through the system and increases the speed of the motor and the rotation of the cutter head inside the well. Closing the needle valve reduces flow to the hydraulic pump and in turn slows the speed of rotation of the cutter head.

It should be noted that if the cutter is turning too fast, a complete cut of the layers of steel casing and cement may not occur. In cases where larger outer casings are present, along with multiple layers of steel casing and cement, the speed of rotation should be reduced in some cases to one revolution in 45 minutes. In cases where only 1-2 layers are present, the speed may be increased to one revolution in 3 minutes. If the rotation of the cutter head is too fast the cut is not complete. If the rotation of the cutter head is too slow, materials and supplies are wasted. It is recommended that there be constant monitoring by the operator during the cutting process.

When the cut is complete, the operator closes the valve on the abrasive pot to stop flow of the abrasive feed to the cutter head. This allows for all material to be suctioned through the abrasive feed line preventing clogging of the system. After the line is empty, the operator places the pump and engine to idle speed and removes all water pressure from the system. The pump and engine may then be shut down. All water, hydraulic, and abrasive feed lines may be disconnected.

The locking handles may be released and the centralizer system may be loosened and the cutter system connected by a lifting strap to the block and tackle system. The cutter system may then be lifted slowly from the casing and sprayed to remove dirt and grime that has built up during the cut. When the unit is completely out of the well, it may be lowered for transport.

The cutter head system may then be disassembled and cleaned, being sure to remove all traces of abrasive from the focus tube and cutter head assembly. The centralizer system may be cleaned of all debris and lubricated and inspected for ease of movement. All moving parts may be thoroughly cleaned.

The cut casing/wellhead from the ground may removed by any suitable means such as a backhoe to shake and or rotate the casing to loosen it from the earth. Next a sling may be attached and the casing pulled from the ground. A plug assembly may be inserted into the top of the casing string that is left below ground and the hole left after the extraction, may be filled with dirt.

It will be appreciated that the embodiments, components, methods and uses outlines above are merely illustrative of embodiments of the invention and are not intended to be limiting in any way. Modifications may be made to the embodiments, components, methods and uses without departing from the contemplated invention.

We claim:

1. An ultra-high pressure (UHP) cutting device for insertion into a wellbore for cutting the casing of the wellbore from within the wellbore, the UHP cutting device comprising:
- a UHP hose connector for connection with a UHP hose in communication with a fluid source;
- a rotatable UHP tube with a top end in fluid communication with the UHP hose connector and a bottom end opposite the top end;
- a rotating means in operational communication with the UHP tube for rotating the UHP tube during operation of the cutting device;
- a cutter head in fluid communication with the bottom end of the UHP tube, the cutter head comprising:
  - a UHP elbow for changing the direction of UHP fluid flow from a direction substantially parallel with the wellbore to a direction toward the inner surface of the wellbore;
  - an abrasive feed port for connection with an abrasive feed line for receiving abrasive to be mixed with the UHP fluid; and
  - a focus tube for directing the mixture of UHP fluid and abrasive out of the cutter head and toward the inner surface of the wellbore to be cut;
- a hollow housing situated around a majority of the length of the UHP tube, the housing fixed to a non-rotating component of the cutting device such that the housing remains stationary during rotation of the UHP tube; and
- a centralizer device for centering the UHP tube in the wellbore during operation of the cutting device, the centralizer device comprising:
  - a centralizer adjustment block slidable along the housing and lockable to the housing to prevent sliding of the centralizer adjustment block when locked;
  - an expandable centralizer rod system comprising a series of rods and hinges;
  - centralizer adjustment rods connected at an upper end to the centralizer adjustment block and at a lower end to the centralizer rod system such that downward sliding of the centralizer adjustment block operates the hinges of the centralizer rod system and expands the outside diameter of the centralizer rod system and upward sliding of the centralizer adjustment block operates the hinges of the centralizer rod system to collapse the outside diameter of the centralizer rod system;
  - a locking device in communication with the centralizer adjustment rods, wherein operation of the device provides for a small expansion of the centralizer rod system via the centralizer adjustment rods for locking the centralizer rod system against an inner surface of the wellbore; and
  - a centralizer mounting bracket fixed to the housing for connection of the centralizer device to the cutting device;
  - wherein expansion of the centralizer rod system continues until the rods of the centralizer rod system contact the inner surface of the wellbore centers the UHP tube in the wellbore.

2. The cutting device of claim 1, wherein the locking device is a locking handle or a locking bolt.

3. The cutting device of claim 1, wherein the cutting head further comprises an orifice assembly for reducing the fluid flow rate and increasing the fluid pressure.

4. The cutting device of claim 1, further comprising a gear reduction unit in communication with the rotating means and the UHP tube for reducing the rate of rotation of the UHP tube provided by the rotation means.

5. The cutting device of claim 4, wherein the rotating means is a hydraulic motor.

6. The cutting device of claim 1, wherein the rotating means is a hydraulic motor.

7. The cutting device of claim 1, further comprising a UHP swivel attachment connected to the UHP hose connector and the UHP tube, the UHP swivel attachment providing a sealed rotatable connection between the UHP tube and the UHP hose connector allowing the UHP tube to rotate while the UHP hose connector remains stationary.

8. An ultra-high pressure (UHP) cutting device for insertion into a wellbore for cutting the casing of the wellbore from within the wellbore, the UHP cutting device comprising:
- a UHP hose connector for connection with a UHP hose in communication with a fluid source;
- a rotatable UHP tube with a top end in fluid communication with the UHP hose connector and a bottom end opposite the top end;
- a rotating means in operational communication with the UHP tube for rotating the UHP tube during operation of the cutting device;
- a cutter head in fluid communication with the bottom end of the UHP tube, the cutter head comprising:
  - a UHP elbow for changing the direction of UHP fluid flow from a direction substantially parallel with the wellbore to a direction toward the inner surface of the wellbore;
  - an abrasive feed port for connection with an abrasive feed line for receiving abrasive to be mixed with the UHP fluid; and
  - a focus tube for directing the mixture of UHP fluid and abrasive out of the cutter head and toward the inner surface of the wellbore to be cut; and
- a UHP manifold in fluid communication with the UHP tube and the cutter head, the UHP manifold comprising a plurality of fluid transmission holes, each hole suitable for connection with the cutter head to orient the cutter head at a different offset from the UHP tube thereby providing a different offset for the focus tube.

9. An ultra-high pressure (UHP) cutting device for insertion into a wellbore for cutting the casing of the wellbore from within the wellbore, the UHP cutting device comprising:
- a UHP hose connector for connection with a UHP hose in communication with a fluid source;
- a rotatable UHP tube with a top end in fluid communication with the UHP hose connector and a bottom end opposite the top end;
- a UHP swivel attachment connected to the UHP hose connector and the UHP tube, the UHP swivel attachment providing a sealed rotatable connection between the UHP tube and the UHP hose connector allowing the UHP tube to rotate while the UHP hose connector remains stationary;
- a hollow housing situated around a majority of the length of the UHP tube, the housing fixed to a non-rotating component of the cutting device such that the housing remains stationary during rotation of the UHP tube;
- a rotating means in operational communication with the UHP tube for rotating the UHP tube during operation of the cutting device;
- a gear reduction unit in communication with the rotating means and the UHP tube for reducing the rate of rotation of the UHP tube provided by the rotation means;
- a cutter head in fluid communication with the bottom end of the UHP tube, the cutter head comprising:

a UHP elbow for changing the direction of UHP fluid flow from a direction substantially parallel with the wellbore to a direction toward the inner surface of the wellbore;

an abrasive feed port for connection with an abrasive feed line for receiving abrasive to be mixed with the UHP fluid;

a focus tube for directing the mixture of UHP fluid and abrasive out of the cutter head and toward the inner surface of the wellbore to be cut; and a centralizer device for centering the UHP tube in the wellbore during operation of the cutting device, the centralizer device comprising:

a centralizer adjustment block slidable along the housing and lockable to the housing to prevent sliding of the centralizer adjustment block when locked;

an expandable centralizer rod system comprising a series of rods and hinges;

centralizer adjustment rods connected at an upper end to the centralizer adjustment block and at a lower end to the centralizer rod system such that downward sliding of the centralizer adjustment block operates the hinges of the centralizer rod system and expands the outside diameter of the centralizer rod system and upward sliding of the centralizer adjustment block operates the hinges of the centralizer rod system to collapse the outside diameter of the centralizer rod system;

a locking device in communication with the centralizer adjustment rods, wherein operation of the device provides for a small expansion of the centralizer rod system via the centralizer adjustment rods for locking the centralizer rod system against an inner surface of the wellbore; and a centralizer mounting bracket fixed to the housing for connection of the centralizer device to the cutting device;

wherein expansion of the centralizer rod system continues until the rods of the centralizer rod system contact the inner surface of the wellbore centers the UHP tube in the wellbore.

10. The cutting device of claim 9, wherein the rotating means is a hydraulic motor.

11. The cutting device of claim 9, wherein the cutting head further comprises an orifice assembly for reducing the fluid flow rate and increasing the fluid pressure.

12. The cutting device of claim 9, further comprising a UHP manifold in fluid communication with the UHP tube and the cutter head, the UHP manifold comprising a plurality of fluid transmission holes, each hole suitable for connection with the cutter head to orient the cutter head at a different offset from the UHP tube thereby providing a different offset for the focus tube.

* * * * *